US006411262B1

(12) United States Patent
Luh et al.

(10) Patent No.: US 6,411,262 B1
(45) Date of Patent: Jun. 25, 2002

(54) SHAPED REFLECTOR ANTENNA SYSTEM CONFIGURATION FOR USE ON A COMMUNICATION SATELLITE

(75) Inventors: Howard Ho-shou Luh, Sunnyvale; I. Mariana Suarez-Barnes, San Jose, both of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 45 days.

(21) Appl. No.: 09/643,269

(22) Filed: Aug. 22, 2000

(51) Int. Cl.[7] ..... H01Q 19/14

(52) U.S. Cl. ..... 343/781 P; 343/781 CA; 343/DIG. 2

(58) Field of Search ..... 343/781 P, 781 CA, 343/781 R, DIG. 2; H01Q 19/14

(56) References Cited

U.S. PATENT DOCUMENTS 5,402,137 A * 3/1995 Ramanujam et al. .... 343/781 P
5,546,097 A * 8/1996 Ramanujam et al. ... 343/781 R

* cited by examiner

*Primary Examiner*—Hoanganh Le
(74) *Attorney, Agent, or Firm*—Kenneth W. Float

(57) ABSTRACT

A shaped reflector antenna system for use on a communication satellite that comprises a plurality of shaped reflector antenna configurations. In an exemplary system, a first one of the antenna configurations is a diverged shaped reflector antenna and a second one of the antenna configurations is a converged shaped reflector antenna. Each of the shaped reflector antennas comprise a main reflector, a subreflector, and a feed horn. The feed horn illuminates the subreflector with RF energy in the shape of a feed cone that is reflected to the main reflector. The direction of RF energy propagation emitted by each of the shaped reflector antennas is in a direction that is different from a direction defined by a vector between a predetermined vertex and focal point associated with the respective shaped reflector antenna. In a specific embodiment, the direction of the coverage for the diverged shaped reflector antenna is counterclockwise with respect to a direction defined by a vector between a predetermined vertex and focal point associated with the shaped reflector antenna. The direction of the coverage for the converged shaped reflector antenna is clockwise with respect to a direction defined by a vector between a predetermined vertex and focal point associated with the shaped reflector antenna.

2 Claims, 5 Drawing Sheets

SHAPED REFLECTOR ANTENNA SYSTEM CONFIGURATION FOR USE ON A COMMUNICATION SATELLITE

BACKGROUND

The present invention relates generally to reflector antenna systems, and more particularly, to a shaped reflector antenna system for use on a communication satellite.

The assignee of the present invention deploys communication satellites containing communications systems. Gregorian reflector antenna systems are typically used on such communication satellites. Although the assignee of the present invention has investigated numerous antenna configurations for use on satellites that it has developed, the use of two types of shaped reflector antenna systems for reducing the cross polarization level on a satellite has heretofore not been addressed.

Accordingly, it is an objective of the present invention to provide for a shaped reflector antenna system configuration for use on a communication satellite to improve the communication system performance.

SUMMARY OF THE INVENTION

To accomplish the above and other objectives, the present invention provides for a shaped reflector antenna system configuration for use on a communication satellite. The present invention addresses types and arrangements of shaped reflector antennas that are used in the shaped reflector antenna system used on the communication satellite to improve the communication system performance.

An exemplary antenna system comprises a plurality of shaped reflector antenna types. A first one of the antenna types is a diverged shaped reflector antenna and a second one of the antenna types is a converged shaped reflector antenna. Each of the shaped reflector antennas comprise a main reflector, a subreflector, and at least one feed horn. The feed horn illuminates the subreflector with RF energy in the shape of a feed cone that is reflected to the main reflector.

In the antenna system, the direction of RF energy propagation emitted by each of the shaped reflector antennas is in a direction that is generally different from a direction defined by a vector between a predetermined vertex and focal point associated with the respective shaped reflector antenna. In a specific embodiment, the direction of the coverage for the diverged shaped reflector antenna is counterclockwise with respect to a direction defined by a vector between a predetermined vertex and focal point associated with the diverged shaped reflector antenna. The direction of the coverage for the converged shaped reflector antenna is clockwise with respect to a direction defined by a vector between a predetermined vertex and focal point associated with the converged shaped reflector antenna.

The shaped reflector antenna configurations described in the present invention exhibit a reduced cross polarization level, and thus will improve the performance of a communication system in which they are employed. The shaped reflector antenna system configuration is intended for use on an LS2020™ satellite developed by the assignee of the present invention.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1A:
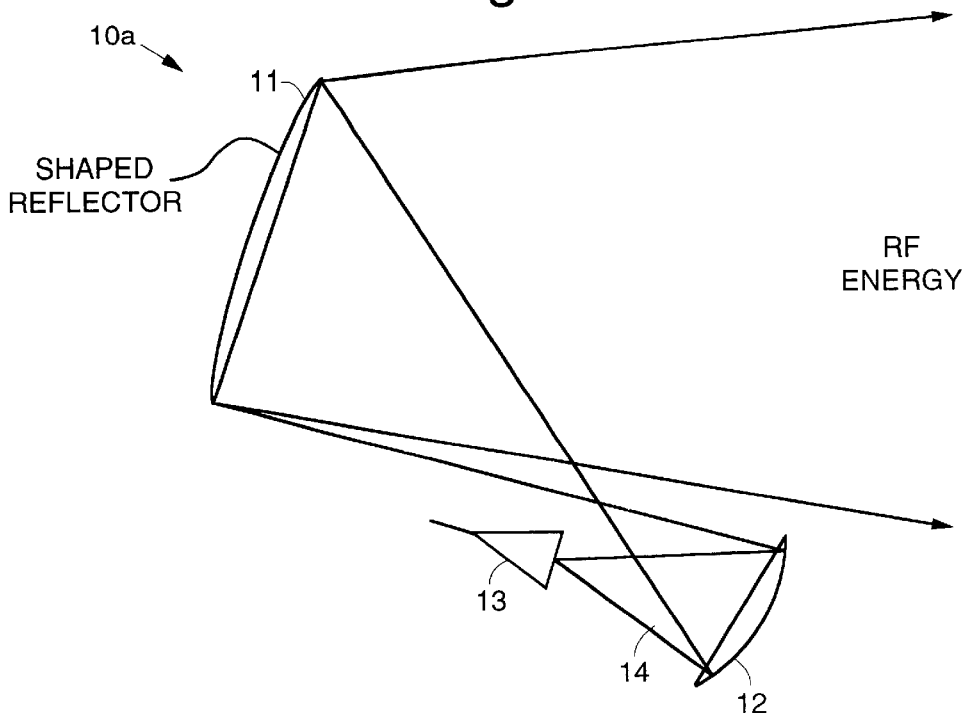
FIG. 1*a* illustrates a diverged shaped reflector antenna configuration that may be employed in the present invention.
Figure 1B:
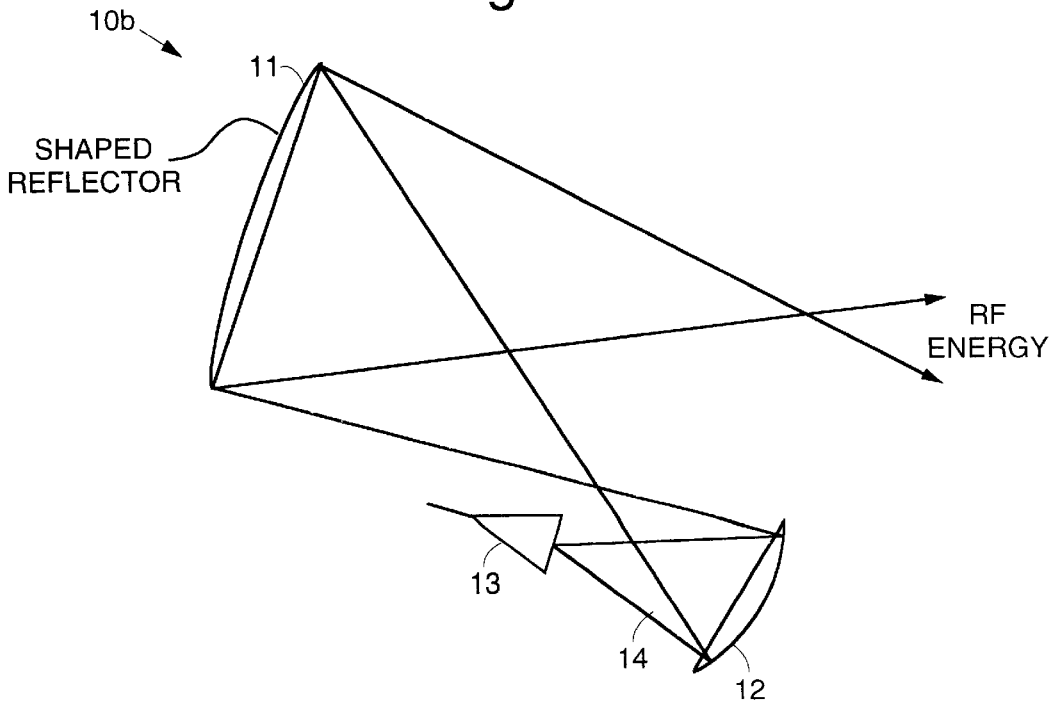
FIG. 1*b* illustrates a converged shaped reflector antenna configuration that may be employed in the present invention.

Referring to the drawing figures, FIGS. 1*a* and 1*b* illustrate side views of exemplary reflector antenna configurations 10 comprising diverged and converged shaped reflector antennas 10*a*, 10*b*, respectively, that may be employed in the present invention. The diverged and converged shaped reflector antennas 10*a*, 10*b* each include a main reflector 11, a subreflector 12, and a feed horn 13. The feed horn 13 illuminates the subreflector 12 with RF energy in the shape of a feed cone 14 which is in turn reflected to the main reflector 11.

The main reflector 11 reflects the feed cone 14 to produce a beam of RF energy on the earth, for example. In the case of the diverged shaped reflector antenna 10*a*, the main reflector 11 diverges outgoing RF energy as shown in FIG. 1*a*. In the case of the converged shaped reflector antenna 10*b*, the main reflector converges the outgoing RF energy as shown in FIG. 1*b*.

Figure 2:
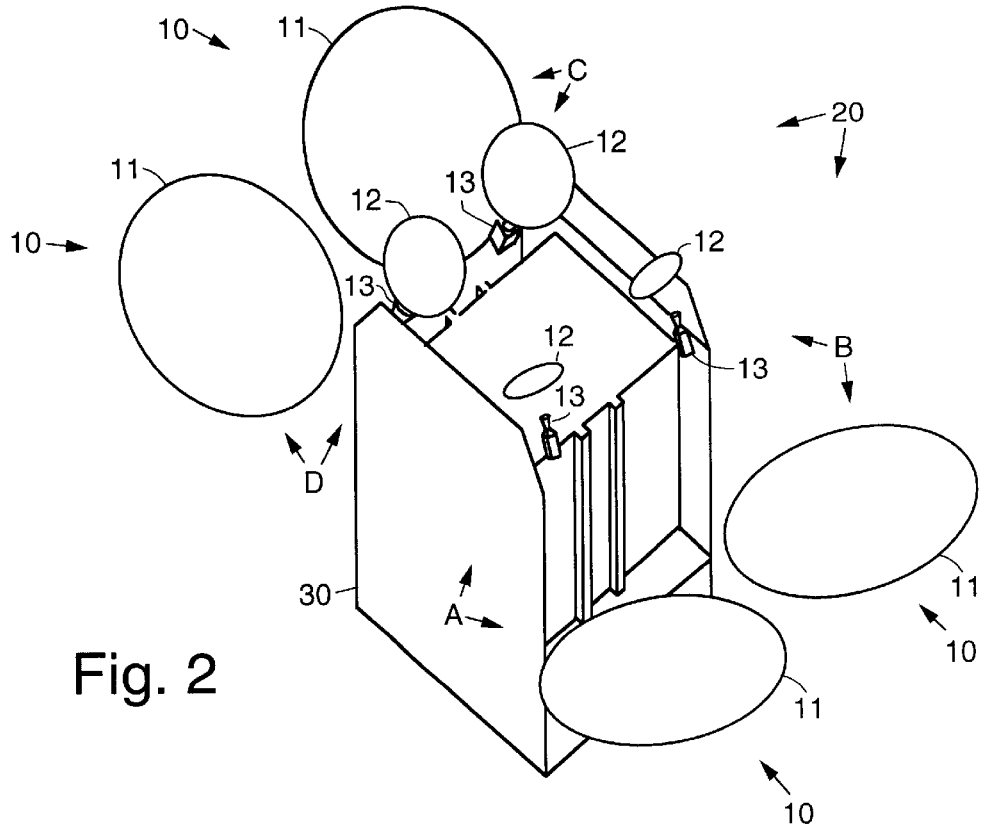
FIG. 2 illustrates an exemplary shaped reflector antenna system in accordance with the principles of the present invention disposed on a satellite.

Referring now to FIG. 2, it illustrates an exemplary shaped reflector antenna system 20 in accordance with the principles of the present invention that disposed on a satellite 30. A communication satellite 30 usually carries more than two reflector antennas 10. The exemplary shaped reflector antenna system 20 of the present invention includes a plurality of shaped reflector antennas 10*a*, 10*b*, identified generally as antennas A, B, C and D.

More particularly, in the case of an LS2020™ satellite 30 developed by the assignee of the present invention, there may be up to four deployed shaped reflector antennas identified as A, B, C and D. The antennas may comprise diverged or converged shaped reflector antenna configurations 10*a*, 10*b*.

Selected ones of the shaped reflector antenna configurations 10 comprise either the diverged or converged shaped reflector antennas 10*a*, 10*b* shown in FIG. 1*a* or 1*b* respectively. The shaped dual reflector antennas 10*a*, 10*b* shown in FIGS. 1*a* and 1*b* evolved from a classical Gregorian dual reflector antenna 10*c* shown in FIG. 3. The main reflector 1 a of the classical Gregorian reflector antenna 10*c* is a sector of paraboloid. The main reflector in the shaped reflector antenna configurations 10*a*, 10*b* is a distorted sector of paraboloid, shaped to distribute the RF energy where it is desired.

More particularly, the classical Gregorian reflector antenna 10*c* comprises a paraboloidal main reflector 11*a*, a subreflector 12, and a feed horn 13. The feed horn 13 illuminates the subreflector 12 with energy in the shape of a feed cone 14 which is in turn reflected to the paraboloidal main reflector 11*a*. The paraboloidal main reflector 11*a* reflects the feed cone 14 to produce a beam on the earth.

Figure 3:
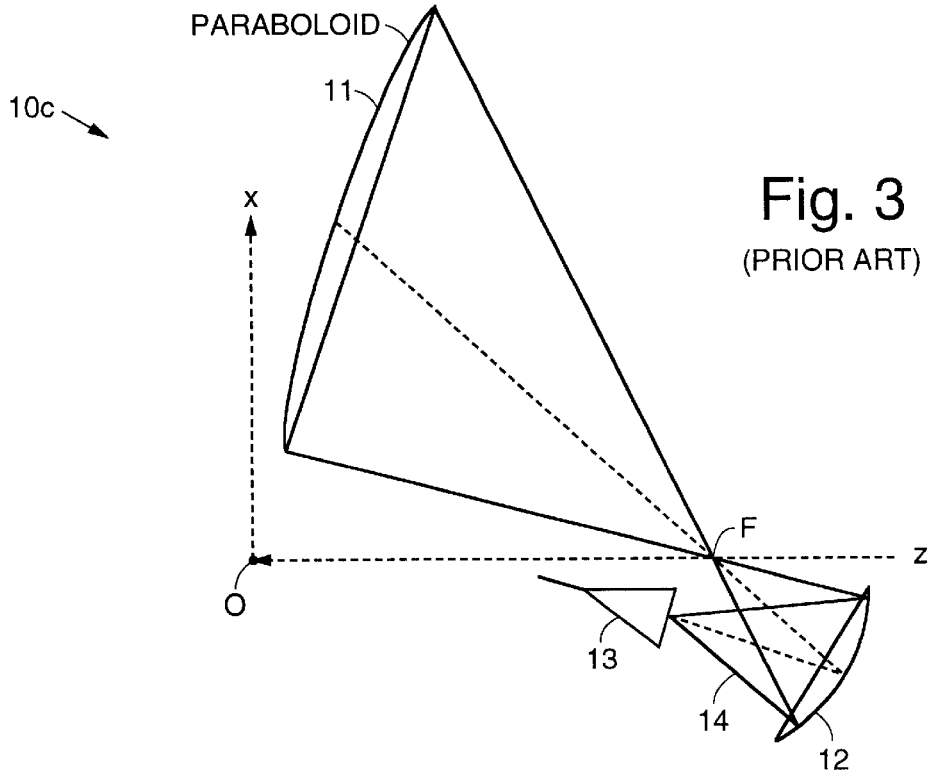
Fig. 3 (PRIOR ART)
FIG. 3 illustrates a classical Gregorian reflector antenna system.

Point O and point F shown in FIG. 3 correspond to the vertex and focal point of the paraboloidal main reflector 1 la, respectively. The vector "OF" is customarily defined as the +z axis of the antenna 10. The +x axis of the Gregorian antenna 10*c* is also shown in FIG. 3. The +z axis also represents the direction of RF energy propagation emitted by the classical Gregorian reflector antenna 10*c*.

Figure 4A:
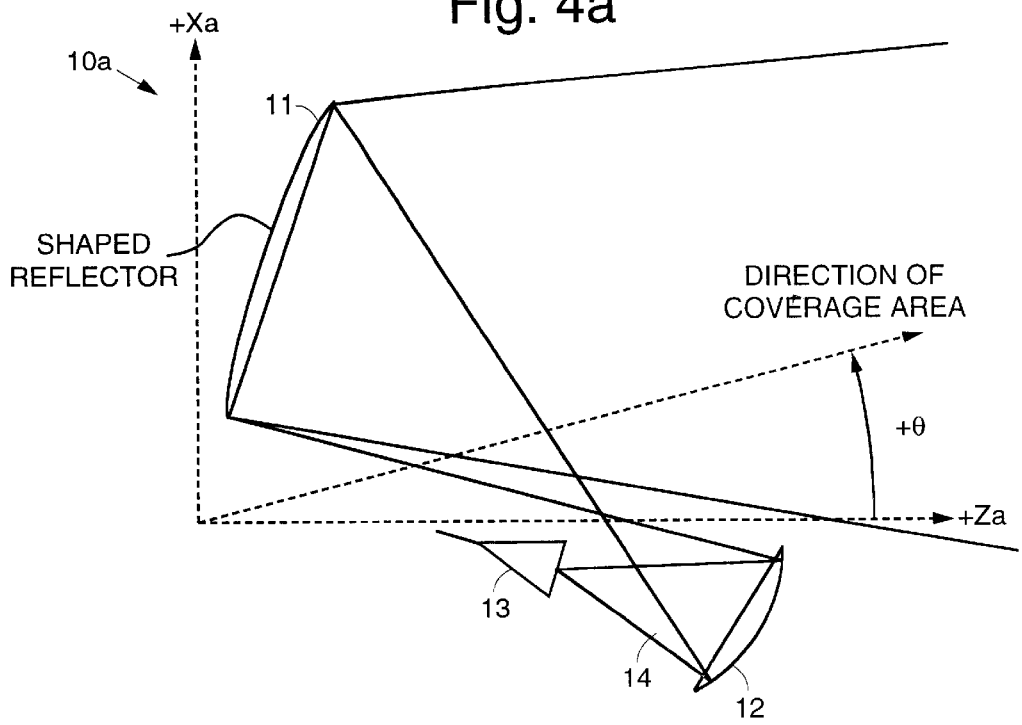
FIG. 4*a* illustrates an exemplary direction of coverage for which the diverged shaped reflector antenna configuration is employed in the present invention.
Figure 4B:
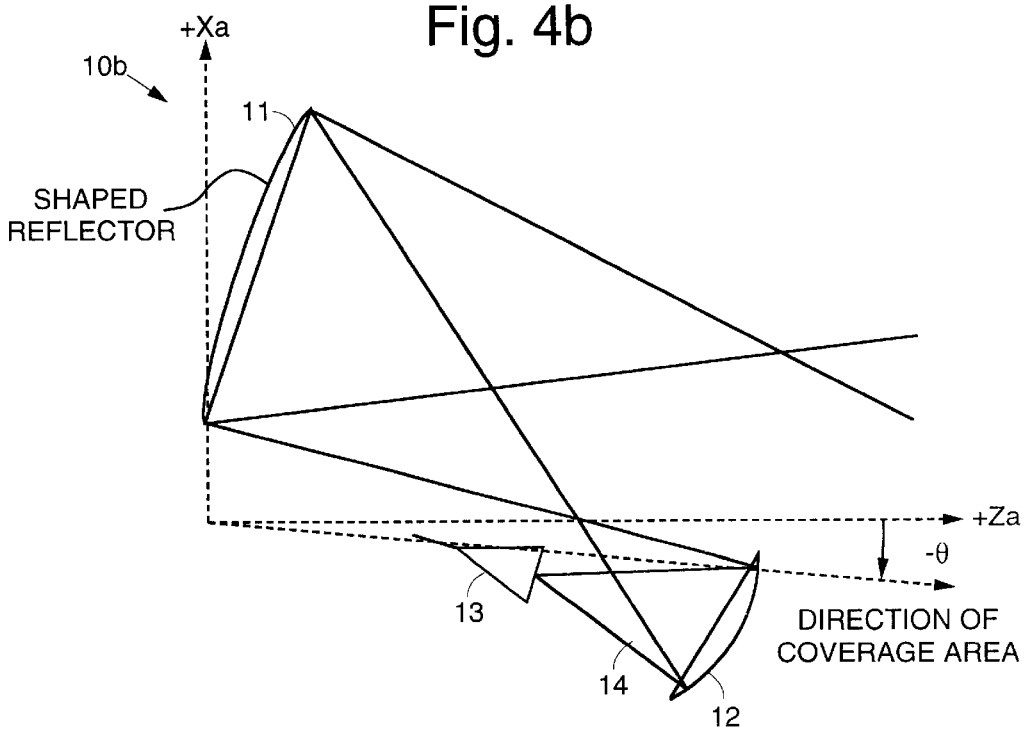
FIG. 4*b* illustrates an exemplary direction of coverage for which the converged shaped reflector antenna configuration is employed in the present invention.

In the case of the shaped reflector antenna configurations 10*a*, 10*b* employed in the present system 20, the direction of the coverage area, i.e., the direction of RF energy propagation is not necessarily in the direction of the +z axis of the antenna 10 as is the case with the Gregorian reflector antenna 10*c*. FIG. 4*a* illustrates an exemplary direction of coverage for which the diverged shaped reflector antenna 10*a* is employed in the system 20 of FIG. 2, while FIG. 4*b* illustrates an exemplary direction of coverage for which the converged shaped reflector antenna 10*b* is employed in the system 20 of FIG. 2. As shown in FIG. 4*a*, the direction of coverage for the diverged shaped reflector antenna 10*a* is counterclockwise (or +θ) with respect to the +z axis, whereas in FIG. 4*b*, the direction of coverage for the converged shaped reflector antenna 10*b* is clockwise (or −θ) with respect to the +z axis.

In the shaped reflector antenna system 20 (FIG. 2) the shaped reflector antennas 10*a*, 10*b* that are used are as follows. A diverged shaped reflector antenna 10*a* is used if the direction of the coverage area is in a counterclockwise direction (i.e., −θ) with respect to the +z axis of the antenna 10. This is the diverged shaped reflector antenna 10*a* shown in FIG. 4*a*. A converged shaped reflector antenna 10*b* is used if the direction of coverage area is in the clockwise direction (i.e., −θ) with respect to the +Z axis of the antenna 10. This is the converged shaped reflector antenna 10*b* shown in FIG. 4*b*.

Figure 5:
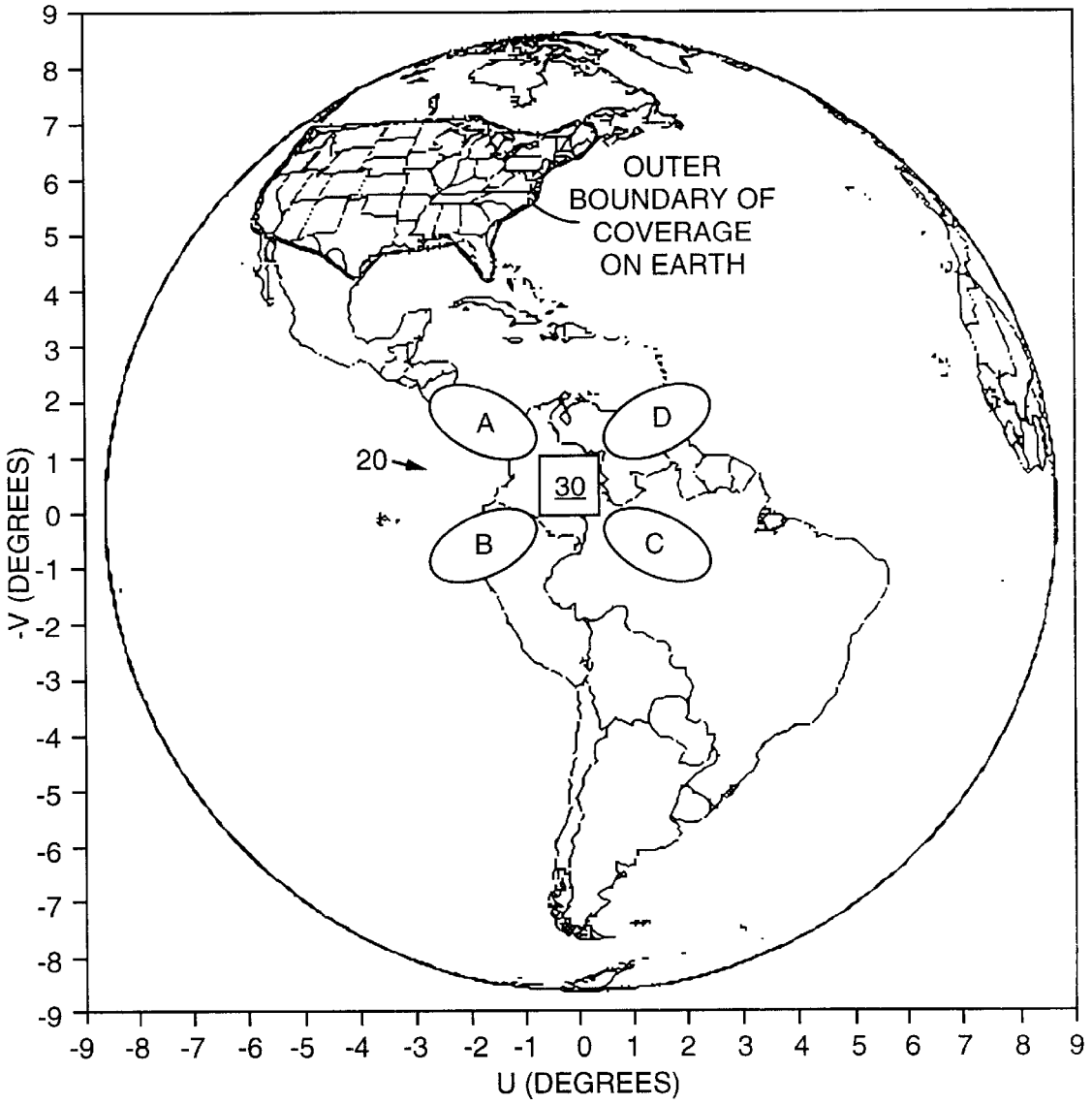
FIG. 5 illustrates an exemplary geosynchronous satellite having a shaped reflector antenna system in accordance with the principles of the present invention disposed thereon along with the exemplary antenna beam coverage provided thereby.

By way of example, reference is made to FIG. 5. FIG. 5 illustrates an exemplary geosynchronous satellite 30 having a shaped reflector antenna system 20 disposed thereon. FIG. 5 shows the location of an orbiting satellite 30 and the area to be covered (the antenna beam coverage), which is shown as the continental United States (CONUS).

Figure 6:
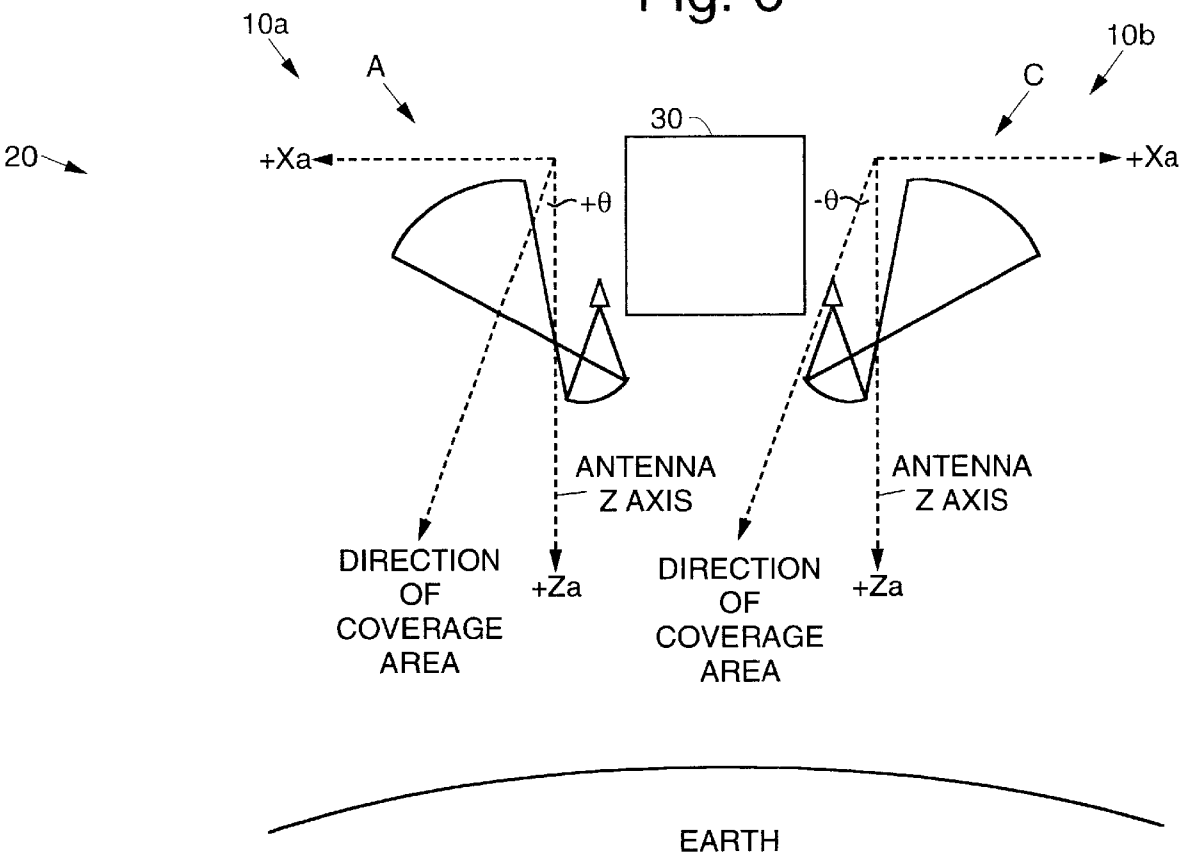
FIG. 6 illustrates a satellite employing the shaped reflector antenna system along with directions of the exemplary coverage area relative to shaped reflector antennas.

Referring to FIG. 6, it illustrates a satellite 30 employing the present shaped reflector antenna system 20 along with exemplary directions of coverage area relative to the shaped reflector antennas 10 (A, B, C, D) used in the system 20. As shown in FIG. 6, the direction of CONUS is +θ for antenna A and is −θ for antenna C. Thus, antenna A should be a diverged reflector antenna 10 shown in FIG. 1*a*, whereas antenna C should be a converged reflector antenna 10 shown in FIG. 1*b*.

The worst case co-polarization to cross-polarization ratio for the system 20 illustrated with reference to FIGS. 5 and 6 that provides CONUS coverage is shown below in Table 1 for antennas A and C in FIGS. 5 and 6 employing both diverged and converged shaped reflector antenna configurations. In Table 1, the larger the value, the better the performance of the system 20.

TABLE 1

Exemplary worst case co- to cross-polarization ratio over CONUS

| | diverged reflector FIG. 1a | converged reflector FIG. 1b |
|---|---|---|
| Antenna A | 35.4 dB | 28.2 dB |
| Antenna C | 29.3 dB | 35.4 dB |

The data indicate that antenna A should be a diverged reflector antenna 10*a*, shown in FIG. 1*a* and antenna C should be a converged reflector antenna 10*b*, shown in FIG. 1*b*.

Thus, a shaped reflector antenna system configuration for use with a satellite communication system which provides optimum cross-polarization performance levels has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An antenna system for use on a satellite, comprising:

a plurality of shaped reflector antenna configurations disposed on the satellite, wherein a first one of the antenna configurations is a diverged shaped reflector antenna and a second one of the antenna configurations is a converged shaped reflector antenna, and wherein each of the shaped reflector antennas comprise:

a main reflector;

a subreflector; and a feed horn;

and wherein the feed horn illuminates the subreflector with RF energy in the shape of a feed cone that is reflected to the main reflector;

and wherein each antenna configuration has a shape that causes RF energy to be emitted in a direction that is different from a direction defined by a vector between a predetermined vertex and focal point associated with the respective shaped reflector antenna.

2. The antenna system recited in claim 1 wherein if the direction of the coverage is counterclockwise with respect to a direction defined by the vector between the predetermined vertex and focal point associated with the shaped reflector antenna, a diverged shaped reflector antenna configuration is used to obtain optimal cross-polarization performance; and if the direction of the coverage is clockwise with respect to a direction defined by the vector between the predetermined vertex and focal point associated with the shaped reflector antenna, a converged shaped reflector antenna configuration is used to obtain optimal cross-polarization performance.

* * * * *